US006931759B2

(12) United States Patent
Jeong et al.

(10) Patent No.: US 6,931,759 B2
(45) Date of Patent: Aug. 23, 2005

(54) APPARATUS FOR SENSING DRYNESS DEGREE IN EXHAUST TYPE CLOTHES DRYER AND CONTROL METHOD USING SAME

(75) Inventors: Hae-Deog Jeong, Gyeongsangnam-Do (KR); Soon-Jo Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/466,276

(22) PCT Filed: Jan. 21, 2002

(86) PCT No.: PCT/KR02/00106

§ 371 (c)(1),
(2), (4) Date: Jul. 15, 2003

(87) PCT Pub. No.: WO02/057533

PCT Pub. Date: Jul. 25, 2002

(65) Prior Publication Data

US 2004/0060197 A1 Apr. 1, 2004

(30) Foreign Application Priority Data

Jan. 20, 2001 (KR) ..... 2001-3444

(51) Int. Cl.[7] ..... F26B 3/00

(52) U.S. Cl. ..... 34/485; 34/486; 34/491; 34/495; 34/604; 324/664

(58) Field of Search ..... 34/485, 486, 491, 34/495, 596, 600, 604, 606; 324/654; 700/208

(56) References Cited

U.S. PATENT DOCUMENTS

| | | | | | |
|---|---|---|---|---|---|
| 2,895,230 | A | * | 7/1959 | Reiley | 34/527 |
| 3,071,864 | A | * | 1/1963 | Menk | 34/527 |
| 3,210,863 | A | * | 10/1965 | Nye, Jr. et al. | 34/533 |
| 3,269,027 | A | * | 8/1966 | Harnden, Jr. | 34/553 |
| 4,649,654 | A | * | 3/1987 | Hikino et al. | 34/493 |
| 4,763,425 | A | * | 8/1988 | Grennan | 34/552 |
| 5,899,005 | A | * | 5/1999 | Chen et al. | 34/528 |
| 6,446,357 | B2 | * | 9/2002 | Woerdehoff et al. | 34/491 |
| 6,784,673 | B2 | * | 8/2004 | Tomasi et al. | 324/664 |

FOREIGN PATENT DOCUMENTS

| | | | |
|---|---|---|---|
| DE | 2200019 | A | 7/1973 |
| FR | 2437459 | A | 4/1980 |
| JP | 06-343796 | A | 12/1994 |
| JP | 10-277292 | A | 10/1998 |
| JP | 2000-279698 | A | 10/2000 |
| KR | 1994-0026878 | A | 12/1994 |
| KR | 1996-0034540 | A | 10/1996 |
| KR | 1996-0034562 | A | 10/1996 |

OTHER PUBLICATIONS

Electric/Gas Dryer model Nos. DLE5977W/DLG5988W product brochure from www.LGappliances.com dated May 2004.*

* cited by examiner

*Primary Examiner*—Stephen Gravini
(74) *Attorney, Agent, or Firm*—McKenna Long & Aldridge LLP

(57) ABSTRACT

An apparatus for sensing a dryness degree in an exhaust type clothes dryer and a control method using the same, includes an electrode sensor for sensing a clothes drying state based on the humidity of the clothes in the drum, and a thermistor for sensing the temperature of the air discharged after drying the clothes. By comparing the clothes drying state and discharged air temperature, the operation of the dryer is controlled, so that the drying of clothes can be accurately performed, thus to improve efficiency and performance of an exhaust type clothes dryer.

14 Claims, 2 Drawing Sheets

APPARATUS FOR SENSING DRYNESS DEGREE IN EXHAUST TYPE CLOTHES DRYER AND CONTROL METHOD USING SAME

TECHNICAL FIELD

The present invention relates to an exhaust type clothes dryer, and more particularly, to an apparatus for sensing dryness degree in exhaust type clothes dryer and its control method that are capable of accurately determining a clothes dryness degree by using an electrode sensor and a temperatures sensor.

BACKGROUND ART

In general, a clothes dryer includes two types: one is an exhaust type for drying clothes by introducing an ambient air, and the other is a dehumidifying type for removing humidity while circulating an inner air and condensing the removed humidity to a water drop state to discharge it.

FIG. 1 is a view showing an internal construction of an exhaust type clothes dryer in accordance with a conventional art.

As shown in FIG. 1, the conventional exhaust type clothes dryer includes: a drum 20 rotatably installed in a case 10 so that clothes can be dried therein; a driving motor (not shown) connected with the drum 20 by a belt 25 so as to rotate the drum 20; a heater 33 installed at an entrance of a suction duct 30 at the rear side of the drum 20 and heating a sucked air; and a blower 37 installed in an exhaust duct 35 at a front lower side of the drum 20 and forcibly discharging air used for drying clothes in the drum 20.

A door 15 is installed at a front side of the case 10 in order to put in or draw out the clothes.

A suction hole 21 is formed at a rear side of the drum 20, into which the ambient air heated while passing the heater 33 can be introduced through the suction duct 30, and an entrance 36 of an exhaust duct 35 is connected at the front side so as to discharge air used for drying the clothes in the drum 20.

Especially, the entrance 36 of the exhaust duct 35 is protruded to be slanted inwardly of the drum 20, and an electrode sensor 40 is installed on the protruded slanted face in order to sense dryness of the clothes.

The electrode sensor 40 is constructed such that two metal plates are positioned side by side and an electric wire is connected to each metal plate to thereby construct a circuit, so that by sensing a change in a voltage flowing through the both metal plates, a dryness degree can be determined.

When the electrode sensor 40 becomes short when clothes with much humidity are in contact with the metal plate, and when clothes with a little humidity after being dried are in contact with the metal plate, a voltage value increased, and thus, the dryness degree of clothes can be determined with the difference between voltage values, The clothes dryness degree sensed by the electrode sensor 40 is inputted to a control computer (not shown) for controlling an operation of the dryer and used for various control operation for clothes drying.

In the conventional exhaust type clothes dryer as constructed above, as the driving motor is operated, the drum 20 connected by the belt 25 is rotated, and at the same time, the blower 37 is rotated.

As the blower 37 is rotated, the ambient air is introduced into the suction duct 30, and as the ambient air passes the heater 33, it is heated and introduced into the drum 20.

The heated air introduced into the drum 20, that is, the hot air, is heat-exchanged with the wet clothes to dry the clothes, and then, the hot air is discharged outwardly of the case 10 through the exhaust duct 35 after drying the clothes.

Especially, in the process of drying the clothes, when the drum 20 is rotated, the clothes being dried inside collide with the electrode sensor 40 protruded into the drum 20, and at this time, a voltage value of the circuit connected with the electrode sensor 40 is changed, so that the dryness degree of the clothes can be determined.

FIG. 2 is a graph showing a dryness degree sensing state using the electrode sensor in accordance with the conventional art.

With reference to FIG. 2, at the initial stage that the clothes contain much humidity, a voltage value sensed by the electrode sensor 40 is low, while as the clothes proceed with drying, the voltage value is gradually increased.

At this time, the dryness degree sensed by the electrode sensor 40, that is, the voltage value change, reaches a certain numeric value (5V in FIG. 2), the control computer determines it's a dryness completion time point and discontinues operation of the dryer.

However, the dryness degree sensing apparatus of an exhaust type dryer in accordance with the conventional art has the following problems.

That is, since the voltage change value according to the humidity of clothes is checked by the electrode sensor 40, the voltage change value is high at the initial stage and the middle stage, so that the clothes dryness can be accurately determined.

However, at the last stage of drying, since the voltage change value is low, so that it is difficult to accurately determine a time point of completion of the clothes dryness.

TECHNICAL GIST OF THE PESENT INVENTION

Therefore, an object of the present invention is to provide an apparatus for sensing dryness degree in exhaust type clothes dryer and its control method that are capable of improving a dryness efficiency and a dryness performance by accurately sensing a dryness degree even at the last stage of drying as well as at the initial and middle stages by determining the dryness degree by using an electrode sensor and a temperature sensor.

DETAILED DESCRIPTION OF THE INVENTION

In order to achieve the above objects, there is provided an apparatus for sensing dryness degree in exhaust type clothes dryer including: a humidity sensing unit positioned inside a drum and sensing a dryness state of clothes by allowing a voltage value to be changed according to the humidity of clothes; a temperature sensing unit positioned at the side of a discharge hole of the drum, drying the clothes and sensing a temperature of the air being exhausted; and a control unit for receiving sense signals from the humidity sensing unit and the temperature sensing unit and determining a dryness degree of the clothes.

In the apparatus for sensing dryness degree in exhaust type clothes dryer of the present invention, an exhaust duct is connected to one side of the drum to outwardly discharge air used for drying the clothes, and the temperature sensing unit is installed in the exhaust duct.

In the apparatus for sensing dryness degree in exhaust type clothes dryer of the present invention, a blower is installed on the exhaust duct to forcibly discharge the air used for drying the clothes in the drum, and the temperature sensing unit is installed at the side of a discharge portion of the blower.

In the apparatus for sensing dryness degree in exhaust type clothes dryer of the present invention, the humidity sensing unit is installed at an entrance of the exhaust duct.

In the apparatus for sensing dryness degree in exhaust type clothes dryer of the present invention, the humidity sensing unit refers to an electrode sensor formed as two metal plates are positioned side by side and a voltage value is varied according to humidity, and the temperature sensing unit is formed as a thermistor that an electric resistance value differs according to a temperature change.

To achieve the above objects, there is also provided a drying control method of an exhaust type dryer comprising the steps of: sensing a dryness state value of clothes by a humidity sensing unit; sensing a temperature value of air being discharged after drying the clothes by a temperature sensing unit; and comparing the dryness state value and the temperature value of the discharged air, and controlling the operation of the dryer.

In the drying control method of an exhaust type dryer of the present invention, a drying completion time point is determined to stop the operation of the dryer by comparing the dryness state value and temperature value of the discharged air. That is, after the clothes drying operation starts, the operation of the dryer is controlled with the dryness state value sensed by the humidity sensing unit until the clothes in the drum reaches a set dryness degree value, and at values above the set dryness degree value, the operation of the dryer is controlled with the temperature value of the discharge air sensed by the temperature sensing unit.

In the drying control method of an exhaust type dryer of the present invention, the dryness degree value is set as a value obtained by drying clothes by 80%, and when the discharged air temperature value reaches the set temperature, it is determined as a time point of completion of drying.

In the drying control method of an exhaust type dryer of the present invention, the heater on/off operation, that when the discharged air temperature value reaches a set upper limit temperature, the heater discontinues its operation, while when the discharged air temperature value reaches a set lower limit temperature, the heater is operated again, is repeatedly performed as many as the set number of times, so as to complete the drying.

As to the apparatus for sensing a dryness degree in an exhaust type dryer and a control method using the same of the present invention, since the dryness degree is determined by using the electrode sensor and the temperature sensor, the dryness degree of clothes can be accurately determined even at the last stage of drying as well as at the initial and middle stages of drying, so that a clothes dryness efficiency and dryness performance can be much improved.

MODE FOR CARRYING OUT THE PREFERRED EMBODIMENTS

The present invention will now be described with reference to accompanying drawings.

Figure 1:
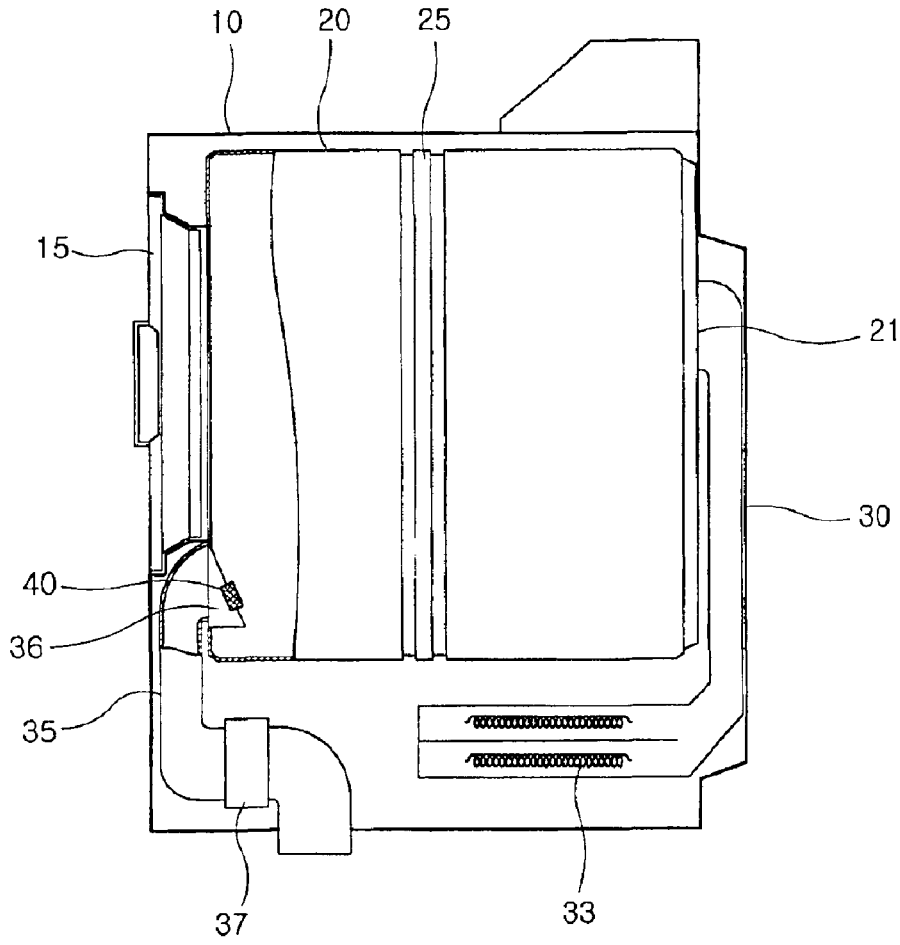
FIG. 1 is a view showing an internal construction of an exhaust type dryer in accordance with a conventional art.
Figure 2:
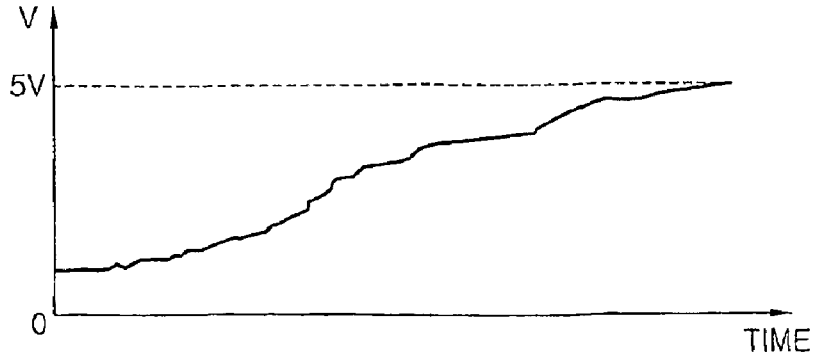
FIG. 2 is a graph showing a dryness sensing state in accordance with the conventional art.
Figure 3:
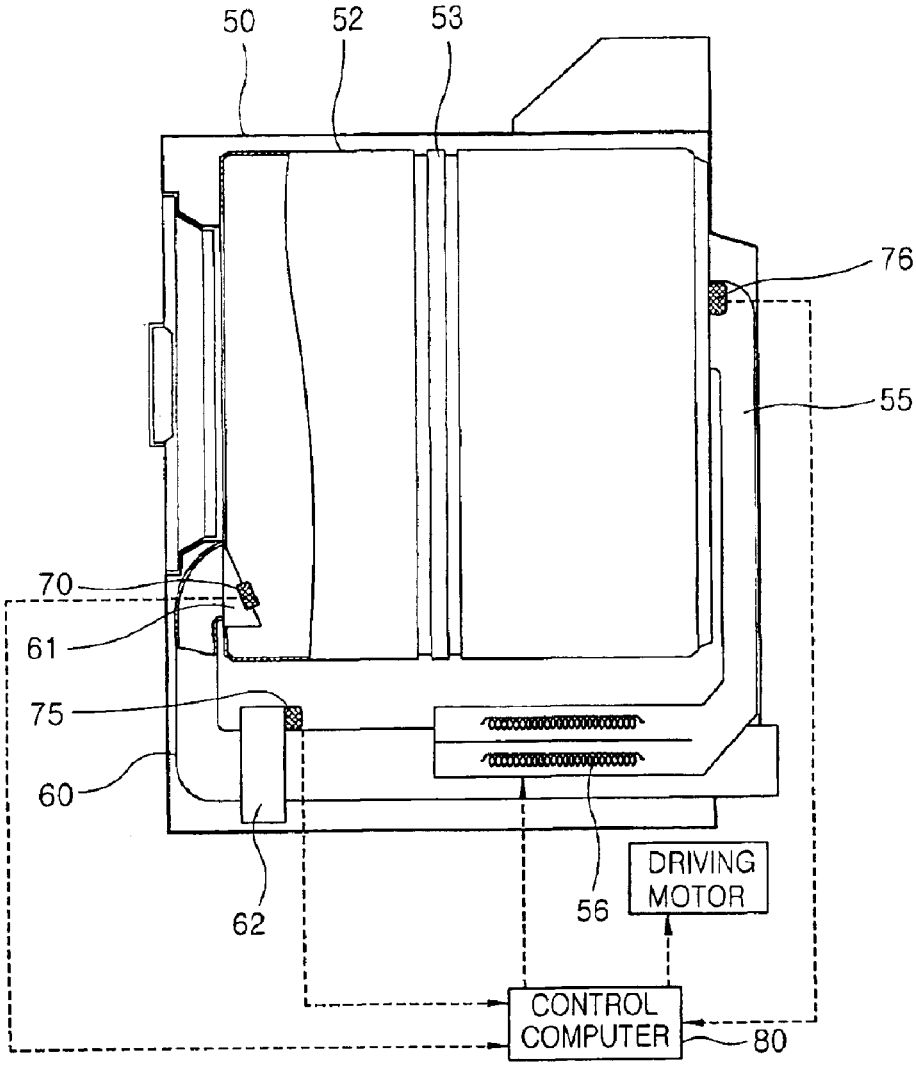
FIG. 3 is a view showing an internal construction of an exhaust type dryer in accordance with the present invention.
Figure 4:
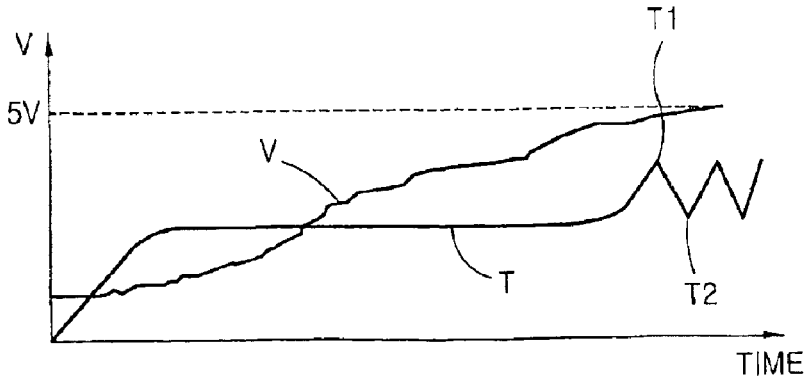
FIG. 4 is a graph showing a dryness sensing state in accordance with the present invention.

FIG. 3 is a view showing an internal construction of an exhaust type dryer in accordance with the present invention; and FIG. 4 is a graph showing a dryness sensing state in accordance with the present invention.

An exhaust type dryer having a dryness degree sensing apparatus of the present invention includes: a drum 52 rotatably installed in a case 50 so that clothes can be dried therein; a driving motor (not shown) connected with the drum 52 by a belt 53 so as to rotate the drum 52; a heater 56 installed at an entrance of a suction duct 55 which is positioned at the rear side of the drum 52 and heating a sucked air; and a blower 62 installed in an exhaust duct 60 which is positioned at a front lower side of the drum 52 and forcibly discharging air used for drying clothes in the drum 52.

The entrance 61 of the exhaust duct 60 is protruded to be slanted inwardly of the drum 52, and an electrode sensor 70 is installed on the protruded slanted face in order to sense dryness of the clothes.

The electrode sensor 70 is constructed such that two metal plates are positioned side by side and an electric wire is connected to each metal plate to thereby construct a circuit, so that by sensing a change in a voltage flowing through the both metal plates, a dryness degree can be determined.

When clothes with much humidity are in contact with the metal plate, the electrode sensor 70 becomes short, and when clothes with a little humidity after being dried are in contact with the metal plate, a voltage value of the electrode sensor 70 increased, and thus, the dryness degree of clothes can be determined with the difference between voltage values.

A thermistor 75 for sensing a temperature of the air being discharged after drying the clothes is installed in the exhaust duct 60 at the side of the discharge hole of the drum 52. The thermistor 75 is constructed to sense a temperature as an electric resistance value is varied according to a temperature change.

The thermister 75 is preferably installed at the side of the discharge portion of the blower 62.

The sense signals of the electrode sensor 70 and the thermistor 75 are inputted to a control computer 80, and the control computer 80 compares the signals inputted from the electrode sensor 70 and the thermistor 75 and determines a clothes dryness degree.

The control computer 80 determines a rotation speed by controlling the driving motor for rotatably driving the drum 52 and the blower 62, and controls the temperature of the air supplied into the drum 52 by controlling the heater 56, thereby controlling the operation of the dryer.

Meanwhile, in addition to the discharge side thermistor 75, a suction side thermistor 76 is installed at the suction hole to which the drum 52 and the suction duct 55 are connected, so as to sense the temperature of the air sucked into the drum 52 and input it to the control computer 80.

The suction side thermister 76 serves to prevent the clothes from deforming or damaging due to overheated air by sensing the suction air temperature when the air heated while passing the heater 56 is introduced into the drum 52.

The control computer 80 receives the sense signal from the suction side thermistor 76, and when the temperature of the sucked air is above a set temperature, the control computer 80 outputs a control signal to the heater 56 to lower a heating temperature of the heater 56 or stops the operaiton of the heater 56.

Drying control method using the exhaust type dryer of the present invention will now be described.

After clothes to be dried is input into the drum 52, when the clothes start drying as the driving motor and the heater 56 are operated, the temperature of the sucked air is sensed by the suction side thermistor 76, a clothes dryness state value (V) of the drum 52 is sensed by the electrode sensor 70, and a temperature value (T) of the air discharged after drying the clothes is sensed by the thermister 75.

The dryness state value (V) and the discharged air temperature value (T) respectively sensed by the electrode sensor 70 and the thermistor 75 are inputted to the control computer 80, and then the control computer 80 compares the two values (V and T) to control the operation fo the driving motor and the heater 56.

As shown in FIG. 4, the dryness state value (V) sensed by the electrode sensor 70 is regularly increased from the dryness initial stage and the dryness last stage, and the discharged air temperature value (T) sensed by the thermistor 75 is sharply increased at the dryness initial stage and the dryness last stage.

Especially, the dryness state value (V) sensed by the electrode sensor 70 shows a great change width at the dryness initial stage and the dryness middle stage, while the discharged air temperature value (T) sensed by the thermistor 75 shows great change width at the dryness initial stage and the dryness last stage.

Thus, the control computer 80 compares the dryness stage value (V) and the discharge air temperature value (T) to determine a clothes dryness proceeding time, that is, a clothes dryness completion time point.

Especially, as described above, at the dryness last stage, the change width of the discharged air temperature value (T) sensed by the thermistor 75 is greater than the change width of the dryness state value (V) sensed by the electrode sensor 70, so that when the discharge air temperature value (T) reaches a set temperature, it is preferably determined to be a dryness completion time point.

In addition, preferably, the control computer 80 controls the operation of the dryer with the dryness state value (V) sensed by the electrode sensor 70 until the dryness middle stage, that is, until the clothes in the drum 52 reaches a set dryness degree value after the clothes dryness operation starts, and controls the operation of the dryer with the discharge air temperature value (T) sensed by the thermistor 75 at the dryness last stage, that is, higher than the set dryness degree value.

In other words, if the set dryness degree value is set as a value obtained by performing drying the clothes by 80%, the control computer 80 controls by using the dryness stage value (V) sensed by the electrode sensor 70 until the clothes is dried by about 80% after the clothes starts drying, and if the clothes dryness degree exceeds 80%, the control computer controls by using the discharged air temperature value (T) sensed by the thermistor 75.

Meanwhile, drying clothes can be completed by repeatediy performing the heater on/off operation that when the discharge air temperature value (T) reaches a set upper limit temperature ($T_1$), the operation of the heater 56 is stopped, while if the discharged air temperature value (T) reaches a set lower limit temperature (T2), the heater 56 is operated again.

The heater on/off operation repetition number of times is set depending on the amount of clothes to be dried or depending on the quality of clothes to be dried.

Namely, if the amount of clothes to be dried is small or if relatively find clothes are dried, when it reaches the initial set upper limit temperature (T1), the heater 56 is stopped from operation, while, if the amount of clothes to be dried is large or if relatively coarse clothes are dried, the heater on/off operation is repeatedly performed up to the set upper limit temperature (T1) so high as not to damage the clothes, to dry the clothes.

The set upper limit temperature (T1) and the set lower limit temperature (T2) according to the amount and quality of the clothes can be determined by setting them as a default value through repeated testing.

INDUSTRIAL APPLICABILITY

As so far described, according to the apparatus for sensing a dryness degree of an exhaust type dryer and its control method, the dryness degree can be determined by using the electrode sensor and the temperature sensor, the dryness degree of clothes can be accurately determined even at the dryness last stage as well as the dryness initial and middle stages. Thus, clothes dryness efficiency and dryness performance can be improved.

What is claimed is:

1. An apparatus for sensing dryness degree in exhaust type clothes dryer comprising:

a humidity sensing unit positioned inside a drum and sensing a dryness state of clothes by allowing a voltage value to be changed according to the humidity of clothes;

a temperature sensing unit positioned at the side of an exhaust duct of the drum, drying the clothes and sensing a temperature of the air being exhausted; and a control unit for receiving sense signals from the humidity sensing unit and the temperature sensing unit and determining a dryness degree of the clothes.

2. The apparatus of claim 1, wherein an exhaust duct is connected to one side of the drum to outwardly discharge air used for drying the clothes, and the temperature sensing unit is positioned in the exhaust duct.

3. The apparatus of claim 2, wherein a blower is installed in the exhaust duct to forcibly discharge the air used for drying the clothes in the drum, and the temperature sensing unit is positioned at the side of a discharge portion of the blower.

4. The apparatus of claim 2, wherein the humidity sensing unit is positioned at an entrance of the exhaust duct.

5. The apparatus of claim 1, wherein the humidity sensing unit refers to an electrode sensor formed as two metal plates are positioned side by side and a voltage value is varied according to humidity, and the temperature sensing unit is formed as a thermistor that an electric resistance value differs according to a temperature change.

6. The apparatus of claim 1, further comprising: a suction air sensing unit disposed at the side of the suction hole of the drum, sensing a temperature of air sucked into the drum and inputting it to the control unit.

7. A drying control method of an exhaust type dryer, comprising the steps of:

sensing a dryness state value of clothes by a humidity sensing unit;

sensing a temperature value of air being discharged after drying the clothes by a temperature sensing unit disposed in a side of an exhaust duct of the dryer;

computing a change in the dryness state value;

computing a change in the temperature value; and controlling an operation of the dryer using the change in the dryness value and the change in the temperature value.

8. The method of claim 7, further comprising the step of:

comparing the dryness state value and the temperature value; and determining when drying is complete as a function of the comparison.

9. The method of claim 7, wherein after the clothes drying operation starts, the operation of the dryer is controlled as a function of the dryness state value-until the clothes in the drum reach a set dryness degree value, and at values above the set dryness degree value, the operation of the dryer is controlled as a function of the temperature value.

10. The method of claim 9, wherein the dryness degree value reached when the clothes are 80% dry.

11. The method of claim 7, wherein drying is complete when the discharged air temperature value reaches a set temperature.

12. The method of claim 7 further comprising:

turning off a heater when the discharged air temperature value reaches a set upper limit temperature;

turning on the heater when the discharged air temperature value reaches a set lower limit temperature; and repeatedly turning the heater on and off a set number of times to complete the drying.

13. The method of claim 12, wherein the set number of times the heater is turned on and off depends on the amount of clothes to be dried.

14. The method of claim 12, wherein the set number of times the heater is turned on and off depends on the quality of clothes to be dried.

* * * * *